US006788187B2

(12) United States Patent
Meyer et al.

(10) Patent No.: US 6,788,187 B2
(45) Date of Patent: Sep. 7, 2004

(54) ELECTRIC RESISTANCE ELEMENT, WHICH CAN BE ELECTROMECHANICALLY REGULATED

(75) Inventors: Carl-Friedrich Meyer, Dresden (DE); Hans-Joachim Scheibe, Dresden (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 10/432,133

(22) PCT Filed: Nov. 17, 2001

(86) PCT No.: PCT/DE01/04364

§ 371 (c)(1),
(2), (4) Date: Jun. 5, 2003

(87) PCT Pub. No.: WO02/41329

PCT Pub. Date: May 23, 2002

(65) Prior Publication Data

US 2004/0041686 A1 Mar. 4, 2004

(30) Foreign Application Priority Data

Nov. 18, 2000 (DE) ..... 100 58 581

(51) Int. Cl.[7] ..... H01C 10/30
(52) U.S. Cl. ..... 338/160; 338/162; 338/307
(58) Field of Search ..... 338/160, 162, 338/307

(56) References Cited

U.S. PATENT DOCUMENTS 4,345,236 A * 8/1982 Eichelberger et al. ..... 338/176
5,093,647 A * 3/1992 Noda et al. ..... 338/160
5,133,321 A * 7/1992 Hering et al. ..... 123/399
5,144,380 A * 9/1992 Kimoto et al. ..... 257/77
5,475,359 A * 12/1995 Hatayama et al. ..... 338/160

* cited by examiner

*Primary Examiner*—Karl D. Easthom
(74) *Attorney, Agent, or Firm*—Barnes & Thornburg

(57) ABSTRACT

The invention relates to an electric resistance element, which can be electromechanically regulated. A layer of a predeterminable width and thickness, consisting of an electrically conductive material with a constant specific electric resistance, is located on a substrate. At least one electric contact connection is also provided and an electric contact element can be displaced mechanically along the surface of said layer. The aim of the invention is to provide an appropriate resistance element that can be produced cost-effectively, with reproducible electric characteristics and a high resistance to wear, without a requirement for additional lubrication. To achieve this, according to the invention, a wear-resistant layer of uniform thickness is configured on the electrically condutive layer situated on the substrate. Said layer consists exclusively of a carbon similar to diamond and has a higher specific electric resistance than that of the layer. The layer of carbon similar to diamond thus lies in contact with the mechanically displaceable contact element.

20 Claims, 1 Drawing Sheet

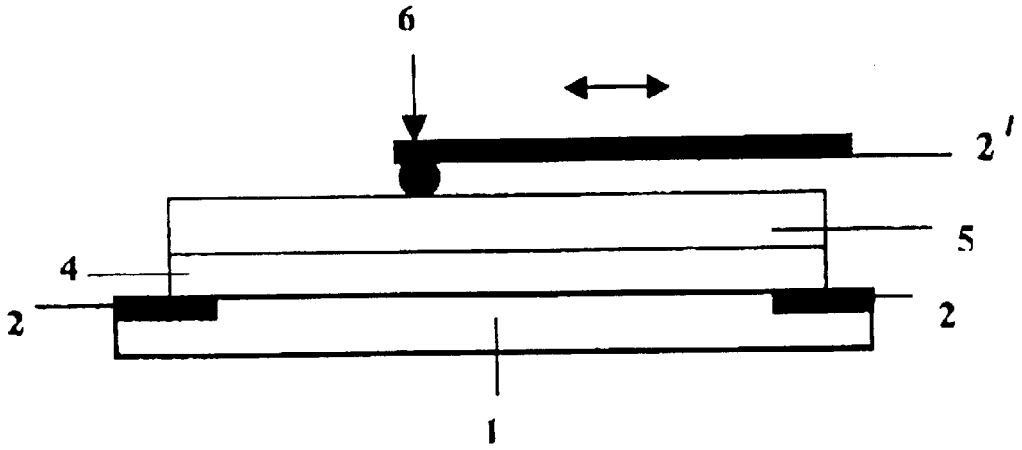
Figur 1
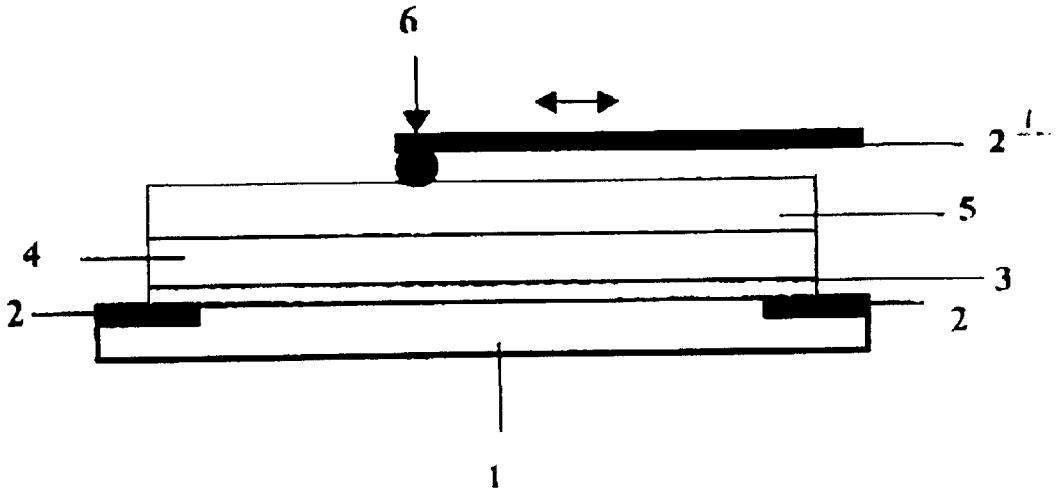
Figur 2

ELECTRIC RESISTANCE ELEMENT, WHICH CAN BE ELECTROMECHANICALLY REGULATED

CROSS-REFERENCE TO RELATED APPLICATIONS

This application is a U.S. national counterpart application of international application serial no. PCT/DE01/04364 filed Nov. 17, 2001, which claims priority to German application serial no. 100 58 581.7 filed Nov. 18, 2000.

BACKGROUND AND SUMMARY OF THE INVENTION

The invention relates to an electromechanically controllable electric resistance element. With such an element a determined resistance, and therefore in electric circuits having a constant voltage, the current or a partial voltage can be selectively adjusted. The adjusted current and/or the partial voltage can be used as a correcting variable for an electric automatic regulation and control, respectively, e.g. of a servo drive.

With the corresponding known solutions a metal, graphite or an appropriately electric conductive composite material has been deposited upon a substrate consisting of a dielectric material, wherein for this screen printing techniques with a subsequent temperature treatment have been employed, for example. Along such an electrically conductive layer a metallic contact element is reciprocated. The contact element is pushed against the surface of this electrically conducting coating with a determined spring force. With these solutions, abrasion of the electrically conducting material due to wear also occurs which is caused by the reciprocation of such contact elements, which therefore leads to a change or the respective specific resistance during the operating period as well.

That's why in WO 00/44032 A1 it has been proposed to substitute the electrically conductive layer for a single layer which comprises at least silicon and a metal in addition to carbon similar to diamond, such that wear of the electrically conductive layer can be appropriately reduced without any additional lubricant as well.

In accordance with the teachings described in WO 00/44032 A1 such a layer is to be formed under vacuum, e.g. with an organosiloxane added, wherein in particular the content of the metal within the layer results in a reduction of the electric resistance, and the layer solely serves as an electric conductor between the mechanically movable metallic contact element and at least an electric contacting terminal.

However, the deposition of such a layer with conventional methods is only possible in a very difficult way, if at all, when a great number of such layers are to be obtained with reproducible electric properties.

If a great spreading of the electric properties of the appropriately made layers is permitted, however, it is urgently required both to calibrate each single layer equivalently and to accomplish expensive calibrations and compensations, respectively, such as with electronic means which increases the manufacturing effort of complete units adequately and influences the cost negatively.

Therefore, it is the object of the invention to provide an electromechanically controllable electric resistance element which can be economically manufactured, in particular with reproducible electric properties, and which comprises a high wear resistance and which achieves a high life period without any lubrication as well.

According to the invention this object is solved with a resistance element having the features of claim 1.

Advantageous embodiments and improvements of the invention can be achieved with the features included in the subordinate claims.

The electromechanically controllable electric resistance element according to the invention provides an electrically conductive layer per se known which is located and formed upon a dielectric substrate, respectively. The electrically conductive layer consists of a homogeneous material and is linearly shaped in a line form or is curved following a radius.

In accordance with the desired electric properties the layer is formed each with a predetermined width and thickness over the total length of the layer in order to ensure a constant specific resistance irrespective of which location a voltage tapping takes place with a contact element which is mechanically movable along the length of the layer. The thickness of the electrically conductive layer should be constant over the total length. In the normal case, this applies to the width of the electrically conductive layer as well. However, the width can also be varied over the length of the layer continuously or in bounces.

Of course, on such an electrically conductive layer there is at least another electric contacting terminal which is preferably located on a front end of the electrically conductive layer. It is possible to provide a second contacting terminal which therefore should be formed advantageously on the opposite front end of the electrically conductive layer.

The mechanically movable electric contact element is pressed with a predetermined pressing force orthogonally upon the surface of the electrically conductive layer, and is able to be moved in a translatory motion or following a circular path, as the case may be. Such a contact element can be formed from a resilient material, for example, which is bent at right angles towards the surface of the electrically conductive layer.

According to the invention, a wear resisting layer separating this layer and the mechanically movable contact element from each other is formed upon the electrically conductive layer, which is exclusively made of carbon similar to diamond and does also not contain any additional hydrogen, in contrast to the solutions known from the prior art. This wear resisting layer is in a contiguous contact with the mechanically movable contact element, and due to its mechanical properties, in particular the frictional behaviour and the achievable hardnesses, wear of the wear resisting layer does not occur although it is allowed to abandon lubricants.

It is necessary to form the wear resisting layer with a constant thickness such that, in each position of the contact element, it has a constant electric boundary resistance between the contact element and the electrically conductive layer which will be added as a constant value to the electric resistance which is determined by the effective conductor length of the electrically conductive layer between a contacting terminal and the respective position of the mechanically movable contact element.

In connection with relevantly suitable manufacturing methods which subsequently still are to be dealt with in more detail, a resistance element according to the invention can be manufactured in a great number of pieces which electric properties thereof can be maintained within close tolerance ranges in a reproducible manner, also with great numbers of pieces.

In addition to the already mentioned dimensional parameters for the electrically conductive layer with respect to the width and thickness thereof it is also allowed to influence the controllable resistance range of the resistance element by selecting an appropriate material for these electrically conductive layers.

Thus, the most different metals or metal alloys can be selected in order to provide low-impedance through high-impedance resistance elements.

However, it is also possible to employ an electrically conductive layer made of graphite carbon.

With definite combinations of material of the substrate and electrically conductive layer it may be favourable to form between them a so-called bonding agent layer, wherein in this case as well the conductivity of such a bonding agent layer should be considerably smaller than that of the electrically conductive layer. Therefore, the bonding agent layer should have insulating properties. Examples of suitable materials of such a bonding agent layer are $Al_2O_3$ or carbon similar to diamond as well.

The less expensive polymer plastics can be employed as substrate materials. Even though it is a matter of most different plastics per se known such as for example PMMA, polycarbonate, polyimides, acrylics and others which can also contain filling materials, in particular fiber reinforcements.

Such a substrate can also be provided appropriately and employed in the form of a film with electrically conductive and wear resisting layers.

However, it is particularly advantageous to select a substrate with a surface which comprises a low surface roughness, if possible, since both the thickness of the electrically conductive layer and the thickness of the wear resisting layer can be kept very thin, and electrically as well as mechanically conditioned, uniform layer thicknesses should be maintained. Thus, of course it is required to form the surface of the wear resisting layer being in a contiguous contact with the mechanically movable contact element with a low roughness to ensure favourable friction relations.

There are various ways to form the electrically conductive layer upon a surface of a substrate and to locate and fix there such a layer, respectively.

Thus, for example a metal layer can be embedded in a flush manner into a contour formed on the substrate surface, if possible, such that at least the area of a layer which will be swept during the motion of the contact element, is exposed.

In this case, for such an electrically conductive layer an adequately formed and dimensioned film can be used.

However, it is also possible for such an electrically conductive layer to be deposited under vacuum on the surface of a substrate with per se known methods in the thin film technique, wherein the layers can be deposited in an appropriate size and shape by means of photolithography processes or the use of masks.

For the wear resisting layer which is exclusively formed from carbon similar to diamond these coating methods are worthy of consideration only.

Such layers can be particularly favourably manufactured with the method known under the designation of Laser-Arc. This method is described in DE 39 01 401 C2 and DE 198 50 218 A1, for example, wherein for this application it shall be fallen back upon the disclosure in application thereof.

However, with the laser-arc method the electrically conductive layer and the already mentioned bonding agent layer, respectively, which is necessary as the case may be can also be manufactured.

To ensure the desired mechanical properties of the resistance element according to the invention it is required at least to form the wear resisting layer upon the surface of the electrically conductive layer with such a width and length ensuring that the mechanically movable contact element is already sweeping and contacting merely areas which consist of carbon similar to diamond.

However, it is more favourably to coat the entire surface of the electrically conductive layer with the wear resisting layer, and more especially it is advantageous to achieve an overlapping coverage of the external edges of an electrically conductive layer as well such that it is also able to function as an additional protective layer, in particular against corrosion.

Considering the mechanical and electric properties it is advantageous to use a mechanically movable contact element which at least provides a portion of graphite carbon, and this portion is in a contiguous contact with the wear resisting layer such that the frictional relations are improved therewith.

As is generally known, layers of carbon similar to diamond comprise SP2 type bond fractions and SP3 type bond fractions for the graphite phase and diamond phase, respectively. With these layers similar to diamond, the electric resistance behaves as well as the hardness of such a layer, which also rises with an increasing SP3 type bond fraction. Therefore, a layer made of carbon similar to diamond with a high SP3 type bond fraction is harder, more wear resisting and has a higher electric resistance as well.

However, for certain cases of application it may be advantageous to form a wear resisting layer as a so-called gradient layer but which is exclusively formed of carbon similar to diamond as well. On that occasion, the continuous gradients, if possible, will be formed through different SP2 and SP3 type bond fractions. The structure of such a gradient layer should be, if possible, such that the SP3 type bond fraction is continuously increasing with respect to the SP2 type bond fraction starting from the side of the wear resisting layer which is in a contiguous contact with the electrically conductive layer.

The wear resisting layer to be used according to the invention should have a hardness of at least 20 GPa, and more especially advantageously a surface hardness of $\geqq 40$ GPa, at least on its surface which is in a contiguous contact with the mechanically movable contact element. The quality of the wear resisting layer can be tested by means of a non-destructive measurement of the modulus of elasticity with laser induced acoustic surface waves using a method which is known under the designation of LAwave.

A controllable electric resistance element according to the invention can be advantageously used as a location and position sensor, respectively, wherein the mechanically movable contact element will be moved into a place or position which corresponds to a definite electric resistance, and as already mentioned at the beginning, with constant voltages, for example, in order to have a definite current flown in a circuit which in turn can be used for controlling other components.

In the following the invention shall be described by way of example wherein

FIG. 1 shows the diagrammatic structure of an embodiment of a controllable resistance element; and FIG. 2 shows a second embodiment with an additional bonding agent layer.

An embodiment of a controllable resistance element according to the invention is diagrammatically shown in FIG. 1.

On that occasion, on a plastic substrate 1 is formed an electrically conductive layer 4 which is connected with each one contacting terminal 2 in an electrically conductive manner on two outer front margins. The contacting terminals 2 can be made of the same metal or another metal such as the electrically conductive layer 4. A wear resisting layer 5 which exclusively consists of carbon similar to diamond is formed between the electrically conductive layer 4 and the mechanically movable contact element 2'. The contact element 2' which can be mechanically reciprocated as is indicated with double the arrow, is pressed with a force acting against the surface of the wear resisting layer 5 as this is explained with arrow 6.

On that occasion, as this has been already expressed in the general part of the description, both the wear resisting layer and the electrically conductive layer 4 have a constant thickness over the total length of the resistance element, and the electrically conductive layer 4 is then additionally formed with a constant width.

The embodiment shown in FIG. 2 merely differs from the embodiment according to FIG. 1 in that an additional bonding agent layer 3 which can also be made of carbon similar to diamond may be present between the substrate 1 and the electrically conductive layer 4. This bonding agent layer 3 can be formed with a constant thickness as well. However, this requirement has not to be urgently met over the total length of the resistance element. It is sufficient, if the bonding agent layer 3 has a constant thickness in the area of the contacting terminals 2 as it is the case with this embodiment.

A wear resisting layer 5 which consists of carbon similar to diamond having a specific electric resistance of $\rho_{DLC}=5*10^3$ Ωcm can result in a constant electric resistance of R=2.5Ω if a thickness of 200 nm is selected for the wear resisting layer, and if the electric contact surface is available between the mechanically movable contact element 2' and the wear resisting layer of 4 $mm^2$. On that occasion, with a constant thickness of the wear resisting layer 5 the transition resistance equals in each position of the contact element 2'.

A controllable resistance element according to the invention, for example, is allowed to have on a plastic substrate an electrically conductive layer 4 made of titanium (specific electric resistance $\rho_{el}=42*10^{-8}$ Ωm) with a length of 40 mm, a width of 6 mm and a thickness of 20 nm. On this electrically conductive layer 4 a wear resisting layer 5 made of carbon similar to diamond can be formed which has a constant thickness of 120 nm, and thus an electric resistance of 5 kΩ will be realized over the total length of the layer. Now, if one varies the thickness of the electrically conductive layer 4 with otherwise the same dimensioning, and if one increases it by the double to 60 nm, then the electric resistance decreases to 2.5 kΩ, and with further doubling the layer thickness to 120 nm of the electrically conducting layer 4 made of titanium then halving of the total electric resistance to 1.25 kΩ will be achieved again.

With other layer materials for the electrically conductive layers, other resistance ranges are allowed to be covered in the low-impedance range and high-impedance range, respectively.

Of course, a plurality of resistance elements according to the invention can be arranged in parallel to each other or can be arranged in the same distances to each other, which are insulated from each other, however, electrically connected to each other by means of the contacting terminals 2 and/or contact element 2'.

What is claimed is:

1. An electromechanically controllable electric resistance element wherein a layer of electrically conductive material having a constant specific electric resistance is located on a substrate in a predetermined width and length, wherein said layer has at least one electric contacting terminal, and an electric contact element is movable along said surface of said layer, wherein a wear resisting layer is provided on said electrically conductive layer, said wear resisting layer having a constant thickness and specific electric resistance higher than that of said electrically conductive layer, said wear resisting layer being exclusively made of carbon similar to diamond which is in contact with said mechanically movable contact element.

2. The resistance element according to claim 1 wherein said electrically conductive layer comprises a metal or a metal alloy.

3. The resistance element according to claim 1 wherein said electrically conductive layer comprises graphite.

4. The resistance layer according to claim 1 wherein a bonding agent layer is formed between said electrically conductive layer and said substrate.

5. The resistance element according to claim 4 wherein said bonding agent layer comprises at least one of $Al_2O_3$ and carbon similar to diamond.

6. The resistance element according to claim 1 wherein said substrate comprises a polymer plastic material.

7. The resistance element according to claim 6 wherein said substrate comprises a flexible film.

8. The resistance element according to claim 1 wherein said electrically conductive layer comprises a flexible film.

9. The resistance element according to claim 1 wherein said wear resisting layer formed from carbon similar to diamond at least covers an area of said electrically conductive layer which is swept during the motion of said electric contact element.

10. The resistance element according to claim 1 wherein said wear resisting layer completely covers said electrically conductive layer and extends beyond the outer edges thereof.

11. The resistance element according to claim 1 wherein at least the portion of said contact element touching said wear resisting layer is formed from graphite.

12. The resistance element according to claim 1 wherein, starting from a surface of said wear resisting layer contacting said electrically conductive layer, the SP3 type bond fraction becomes greater with respect to the SP2 type bond fraction in said carbon similar to diamond.

13. The resistance element according to claim 1 wherein a surface of said wear resisting layer contacted by said electric contact element has a hardness of at least 20 GPa.

14. The resistance element according to claim 12 wherein a surface of said wear resisting layer contacted by said electric contact element has a hardness ≧40 GPa.

15. Use of the resistance element according to claim 1 as a position sensor.

16. The resistance layer according to claim 2 wherein a bonding agent layer is formed between said electrically conductive layer and said substrate.

17. The resistance element according to claim 16 wherein said bonding agent layer comprises at least one of $Al_2O_3$ and carbon similar to diamond.

18. The resistance layer according to claim 3 wherein a bonding agent layer is formed between said electrically conductive layer and said substrate.

19. The resistance element according to claim 18 wherein said bonding agent layer comprises at least one of $Al_2O_3$ and carbon similar to diamond.

20. The resistance element according to claim 2 wherein said substrate comprises a polymer plastic material.

* * * * *